United States Patent [19]

Axmann

[11] 4,394,781

[45] Jul. 26, 1983

[54] SWIMSUIT

[76] Inventor: Otto Axmann, Rheinstrasse 50, 1000 Berlin 41, Fed. Rep. of Germany

[21] Appl. No.: 359,600

[22] Filed: Mar. 18, 1982

[30] Foreign Application Priority Data

Mar. 19, 1981 [DE] Fed. Rep. of Germany ..... 3111280

[51] Int. Cl.[3] ..... A41D 5/00; A41D 9/00; A41C 3/02

[52] U.S. Cl. ..... 2/67; 2/238; 128/469

[58] Field of Search ..... 2/67, 238; 128/469, 128/471, 476

[56] References Cited

U.S. PATENT DOCUMENTS 2,534,934 12/1950 Viniegra ..... 2/238
2,851,037 9/1958 Johnson ..... 128/471
3,033,205 5/1962 Walters ..... 128/469

FOREIGN PATENT DOCUMENTS 803049 2/1951 Netherlands ..... 2/67

*Primary Examiner*—Doris L. Troutman
*Attorney, Agent, or Firm*—Allison C. Collard; Thomas M. Galgano

[57] ABSTRACT

A swimsuit consisting of swim trunks and also, if need be, a corresponding bra, which is improved both esthetically, as well as in its method of making, is made of form inserts which are covered with fabric. The form inserts are in the form of U-shaped clamps so that only the pubic bone and the coccyx are engaged. The form insert for the bra forms cups, each of which encompasses the corresponding breast by more than about two thirds. The swim trunks, as well as the bra, may be simply attached to the body portions to be covered. The fabric cover of the form inserts may consist of any given material. An advantageous feature of the inventive swimsuit is a minimum covering of the body, which still conforms to the ethical national laws, while simultaneously having a maximum esthetic effect and, finally, affording a very economical way of making.

6 Claims, 6 Drawing Figures

SWIMSUIT

FIELD OF THE INVENTION

The invention relates to a swimsuit which may be worn for bathing as well as a suit for play and sports.

BACKGROUND OF THE INVENTION

Conventional swimsuits for the above-stated uses very often consist of only bathing or swim trunks which are supplemented by a corresponding bra in the case of a female wearer. Conventionally, the swim trunks are designed with a waistband and two leg openings, while the bra also has the conventional soft or supple shape. Both parts consist of a suitable material.

This hitherto-known swimsuit is very uncomfortable to wear, although being made of light material, because the elastic or rubber waistband in the swim trunk cuts circumferentially into the skin, as well as into the muscle parts underneath the skin after a short time of wearing, which subsequently results in the clamping off of some vessels. In the same manner, the support bands of the bra, which usually are worn across the shoulders or around the neck and which are tied in the back, also result in cutting into the skin, in particular with fully developed breasts, whose weight must be partially supported by the upwardly extending support bands. Furthermore, the wearer of this swimsuit has the uncomfortable constricted feeling in this swimsuit after taking a swim, i.e., when the swimsuit is soaked full of water.

A further disadvantage, which only comes into play at places where a lot of strange people swim at a beach without changing cabins, is that it is difficult to change from one's daily clothing to the swimsuit without baring parts of the body whose display may be considered a public embarrasment by others and which may also strain the inherent feeling of shame of the person involved. The twists which people go through during a change of clothing, and which very often are very amusing, are very well known.

Finally, the hitherto-known swimsuits very often have a very unesthetic appearance in the case of a wearer who has certain body deficiencies (e.g., fat, hanging bosom, very large posterior), because the swimsuit folds into very ugly folds, especially in the wet condition, so that these body deficiencies are unnecessarily emphasized.

SUMMARY OF THE INVENTION

It is an object of the invention to eliminate all of the aforementioned disadvantages of the conventional swimsuits and to provide a swimsuit which meets the highest esthetic standards.

In accordance with the invention this object of the invention is obtained in that the swimsuit is characterized by an elastic, air penetrable or permeable form insert or frame which is covered with fabric and which substantially has the shape of a U-shaped clamp whose one shank serves to yieldingly engage the wearer's pubic bone and whose other shank serves to yieldingly engage the wearer's coccyx.

The inventive swimsuit is very easily put on. One does not try to keep a balance on one foot first, while introducing the other leg into the opening of the swim trunks and thereafter hopping around on the other leg while trying to put the other leg into the opening of the swim trunks. In contrast thereto, the inventive swim trunks which represents a U-shaped clamp is inserted between the legs and is pushed upwardly into the proper position. In the same manner, the bra which encompasses each breast by about more than two thirds from below, due to its shape, can be put on from front side and it fits so securely that the two back bands are only used to keep the bra in place against additional outside forces, for example, flow forces of the water during swimming.

Since the shape or form inserts of the bottom part and the bra determine their shape, the manufacturing of the inventive swimsuit is particularly simple as far as the fabric is concerned and, therefore, particularly economical. For example, if so-called "stretch" fabrics are used, only a trapezoidal garment has to be cut and sewn together after pulling it over the form insert to adjust to the curved contours thereof. Therefore, a plurality of covers of different colors and designs may be used for the same form insert, so as to give the appearance of "new" swim trunks. The same holds true for the bra.

The wearer of the inventive swim trunks which is open at both sides does not feel so confined as in the case of wearing conventional swim trunks. Since the corresponding bra may consist of very thin back bands, which may be of transparent material, the sides of female wearers are viewable in a particularly esthetic and heretofore unachievable manner. Also, the rear view of the wearers of the inventive swimsuit, which is merely blocked by the rear shank which engages the coccyx, offers a far more natural and therefore a far more esthetic view.

BRIEF DESCRIPTION OF THE DRAWINGS

Other objects and features of the present invention will become apparent from the following detailed description considered in connection with the accompanying drawings, which disclose several embodiments of the invention. It is to be understood that the drawings are to be used for the purposes of illustration only, and not as a definition of the limits of the invention.

In the drawings, wherein similar references characters denote similar elements throughout the several views.

DESCRIPTION OF THE PREFERRED EMBODIMENTS

Figure 1:
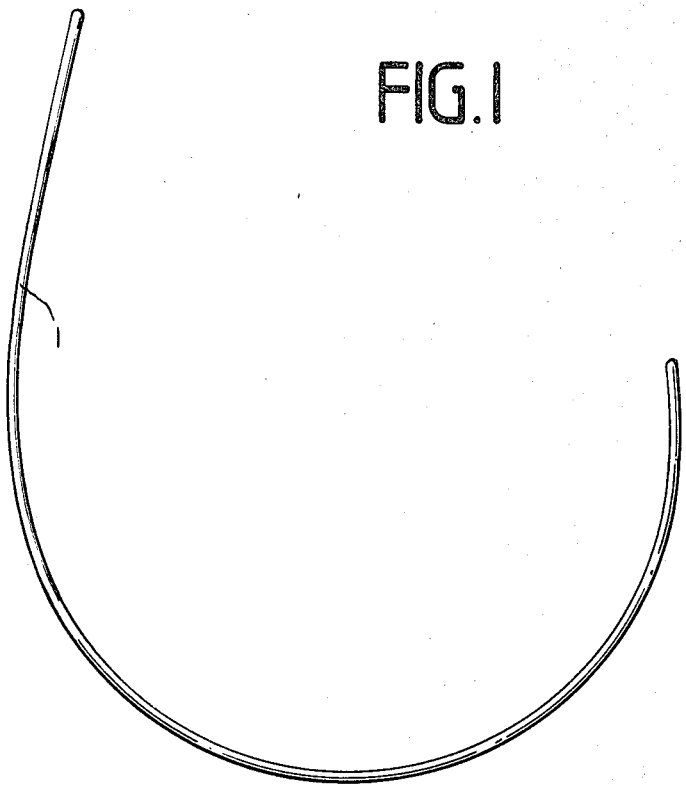
FIG. 1 is a schematically-illustrated side view of an inventive resilient form insert for swim trunks.
Figure 1A:
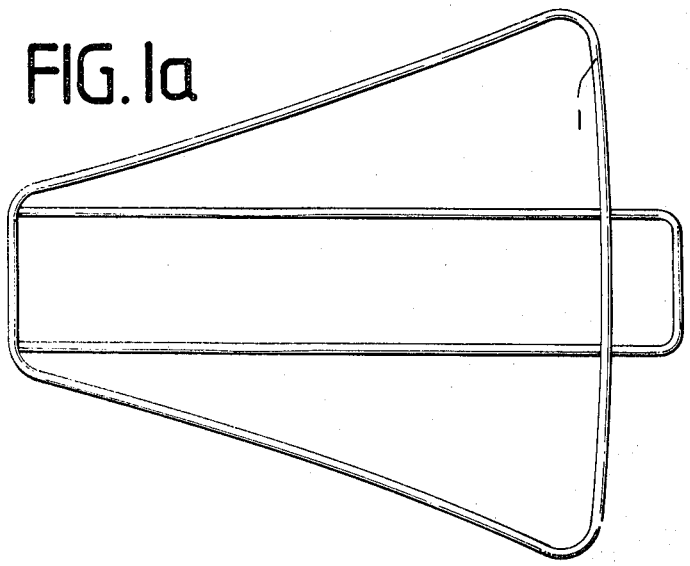
FIG. 1*a* is a front view of the form insert shown in FIG. 1.
Figure 1B:
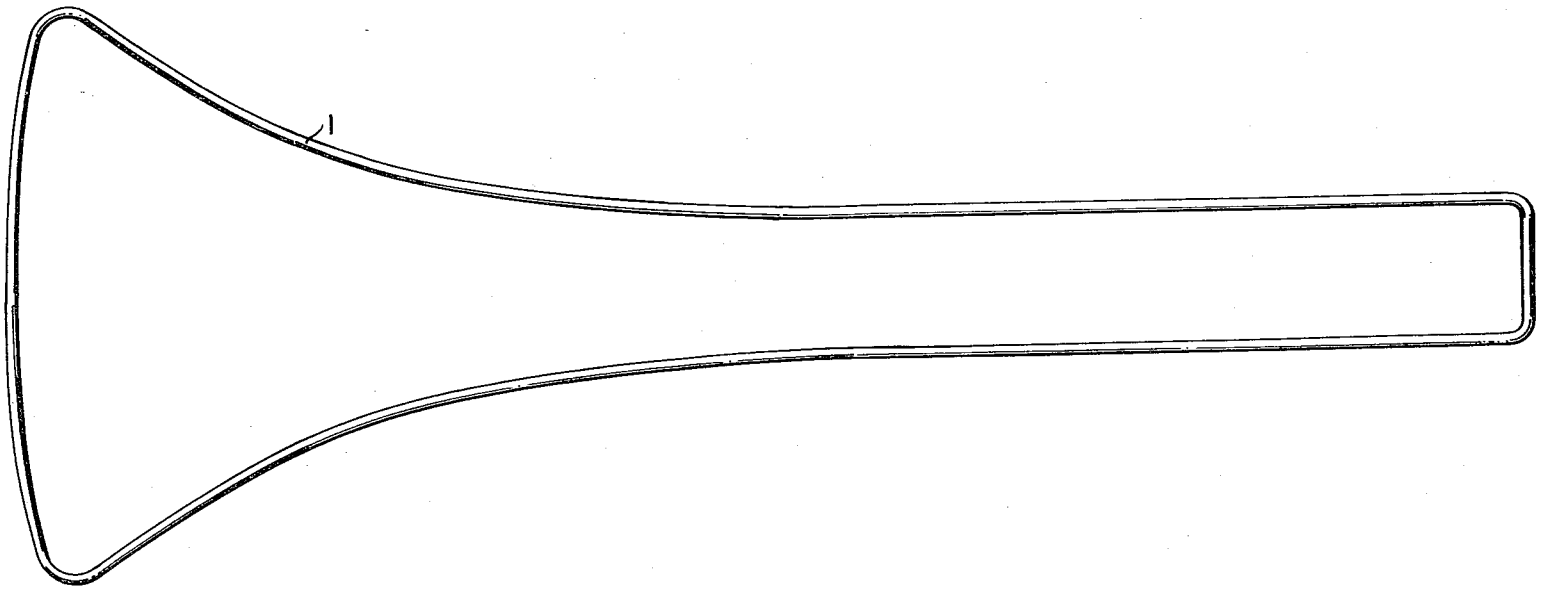
FIG. 1*b* is a plan view of the still flat form insert, shown in curved position in FIGS. 1*a* and 1*b;*

In accordance with FIG. 1*b*, the resilient shape or form insert 1 consisting of a wire is at first bent into a trumpet-like frame in one plane. For example, non-rusting spring wire with a diameter of 1.5 to 2.0 mm may be used. The form insert so formed could already now be covered with a suitable fabric and, if need be, with padding.

Subsequently, the form insert 1 is bent into a useable shape in accordance with FIG. 1, shown in a side view. The longer section shown in this illustration on the left side is the widened front portion which covers the pubic bone, while the right smaller segment represents the rear portion which is defined to engage over the coccyx and cover the anus. FIG. 1*a* shows the front view of the finished bent form insert 1.

Instead of the aforementioned spring steel wire, a wire made of plastic or other material may be used. The form insert may also be made from a thermoplastic material by means of stamping, pushing, molding or injection molding.

Figure 2:
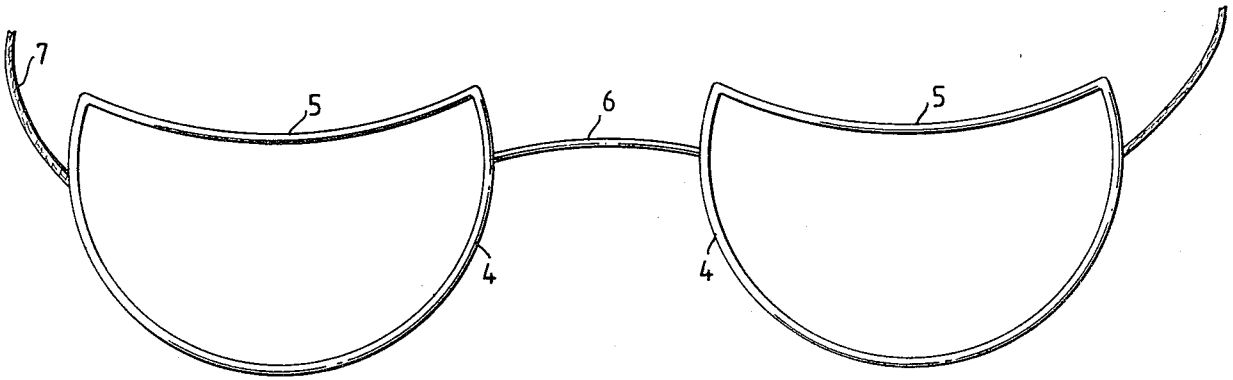
FIG. 2 is a front view of a resilient form insert of one exemplified embodiment for a bra.

In accordance with FIG. 2, the resilient form insert for the bra consists of circular-segment-like curved or arcuate rings 4, whose upper ends are closed by yokes 5 which are curved forwardly to conform to the shape of the breast. Both rings 4 are connected with each other by a rib 6. A back or rear band 7 is mounted on both sides of the shaped resilient form insert.

Figure 3:
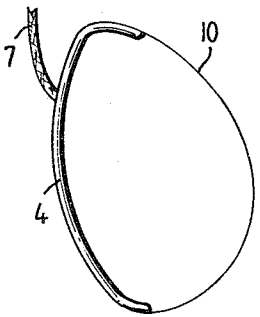
FIG. 3 is a side view of the bra shown in FIG. 2.

After covering with a suitable fabric, the inventive bra has the shape shown in FIG. 3.

Since each cup, 4,5 encompass the corresponding breast by more than two thirds, the cups 4,5 already afford a very secure retention after being put in position. The two back bands 7 are merely provided for security against outside forces (e.g., wind, water flow).

Figure 4:
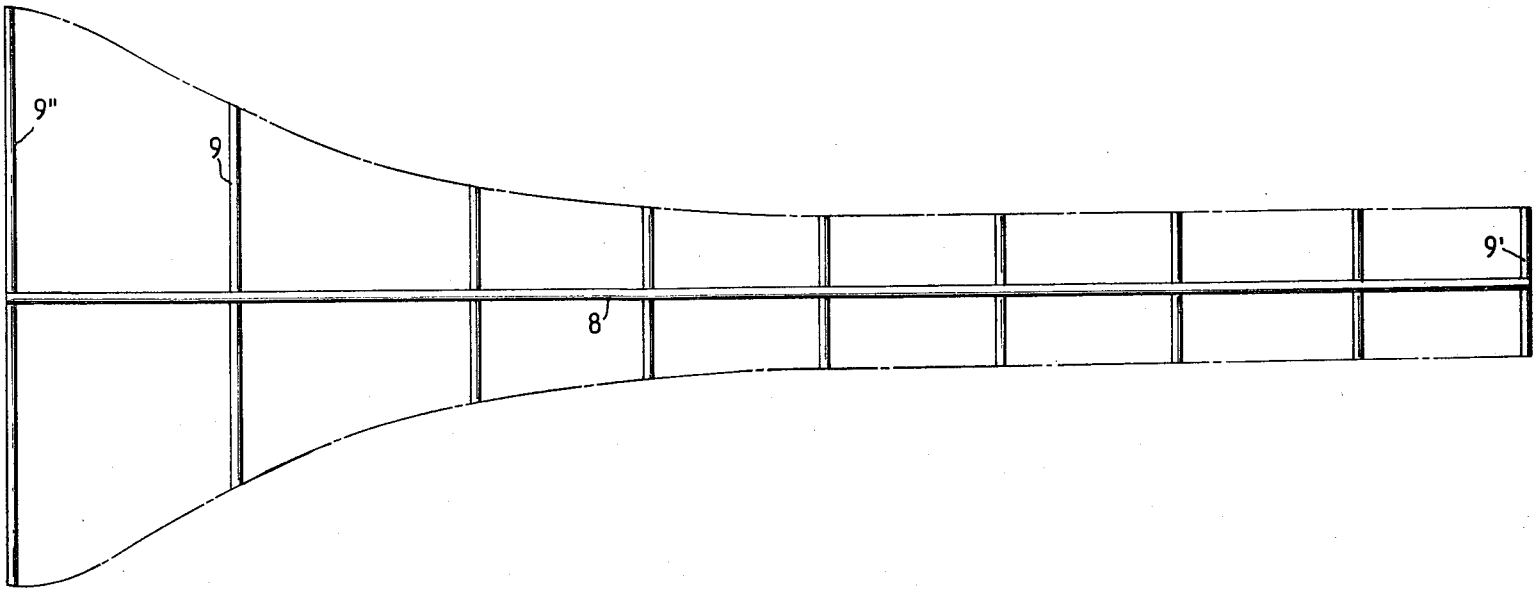
FIG. 4 is an illustration of a further embodiment of an inventive form insert for swim trunks.

In accordance with FIG. 4, a further exemplified embodiment for the form insert of swim trunks consists of a longitudinal rib 8 and a plurality of transverse ribs 9 which may be connected with each other in any suitable manner. For example, the longitudinal rib 8 and the transverse rib 9 may be reduced to half of their thickness at the overlapping locations and may be connected with each other with a water-insoluble adhesive (single or multicomponent adhesive). It is also recommended to make the transverse rib 9 from a highly resilient (elastic) material and to cover the ends with rounded-off caps.

The two outermost transverse ribs 9' and 9'' have curved ends, so as to give the swim trunks a more pleasing appearance. The shaped form or frame is subsequently covered with a suitable fabric. The side contours of the fabric covering 10 are shown in dash-dot lines in FIG. 4.

While only several embodiments of the present invention have been shown and described, it is obvious that many changes and modifications may be made thereunto, without departing from the spirit and scope of the invention.

I claim:

1. A swimsuit comprising a fabric covered, elastic, air-penetrable form insert including a longitudinal rib having a plurality of transverse ribs secured thereto, said insert having the shape of a substantially U-shaped clamp having two shanks, a front shank which serves to resiliently engage the pubic bone of the wearer and a rear shank of which serves to resiliently engage the coccyx of the wearer.

2. The swimsuit of claim 1, wherein said suit is additionally shaped so that said front shank flares upwardly and said rear shank has a substantially uniform width, the positions and lengths of said transverse ribs being so adjusted with respect to each other and with respect to said longitudinal rib that the connecting lines of all end points thereof result in the aforesaid suit shape.

3. The swimsuit of claim 1 or 2, additionally including a bra having cups made of elastic, air-penetrable and fabric-covered form inserts which are connected with each other by means of a rib and which are each dimensioned to enclose each breast by about two thirds, said bra also having two rear bands each secured to one of said cups for safely retaining the cups in their position during use.

4. The swimsuit of claim 1, wherein said form insert is made from an elastic material which retains its shape in water.

5. The swimsuit of claim 4, wherein said material is plastic.

6. The swimsuit of claim 1, wherein said form is made of resilient wire bent to define the contours of said swimsuit.

* * * * *